US005088916A

United States Patent [19]

Furuhashi et al.

[11] Patent Number: 5,088,916

[45] Date of Patent: Feb. 18, 1992

[54] GAS-AIR RATIO CONTROL VALVE DEVICE FOR GAS BURNERS

[75] Inventors: Toshio Furuhashi; Mokoto Hasegawa, both of Shizuoka, Japan

[73] Assignee: EIKEN Kougyo Kabushiki Kaisha, Shizuoka, Japan

[21] Appl. No.: 335,662

[22] PCT Filed: May 27, 1988

[86] PCT No.: PCT/JP88/00518

§ 371 Date: Mar. 27, 1989

§ 102(e) Date: Mar. 27, 1989

[87] PCT Pub. No.: WO89/09463

PCT Pub. Date: Dec. 1, 1988

[30] Foreign Application Priority Data

| | | | |
|---|---|---|---|
| May 28, 1987 | [JP] | Japan | 62-132635 |
| Nov. 2, 1987 | [JP] | Japan | 62-277772 |
| Nov. 24, 1987 | [JP] | Japan | 62-296844 |
| Nov. 24, 1987 | [JP] | Japan | 62-296848 |
| Dec. 14, 1987 | [JP] | Japan | 62-316573 |
| Jan. 17, 1988 | [JP] | Japan | 63-7341 |
| May 2, 1988 | [JP] | Japan | 63-109577 |

[51] Int. Cl.[5] ..... F23N 1/02

[52] U.S. Cl. ..... 431/90; 431/89; 431/12; 239/414; 239/416.5; 239/417

[58] Field of Search ..... 431/10, 12, 159, 187, 431/188, 181, 354, 89, 90, 153, 159, 181; 239/414, 415, 416.5, 417

[56] References Cited

U.S. PATENT DOCUMENTS

| | | | |
|---|---|---|---|
| 1,917,897 | 8/1931 | Morse | 431/188 X |
| 2,290,785 | 7/1942 | Turpin | 239/414 |
| 2,572,675 | 10/1951 | Swenson et al. | 431/89 |
| 3,371,699 | 3/1968 | Riot | 239/416.5 |
| 4,447,010 | 5/1984 | Maeda et al. | 239/417 X |

FOREIGN PATENT DOCUMENTS

| | | | |
|---|---|---|---|
| 560814 | 9/1932 | Fed. Rep. of Germany | 239/417 |
| 0175718 | 10/1983 | Japan | 431/90 |
| 497112 | 12/1938 | United Kingdom | 431/12 |

*Primary Examiner*—Carl D. Price
*Attorney, Agent, or Firm*—Darby & Darby

[57] ABSTRACT

A gas-air ratio control valve for gas burners has a reciprocally movable operating rod (7) which is provided with a primary air flow rate control valve portion (A), a secondary air flow rate control valve portion (B) and a raw gas flow rate control valve portion (G), the opening degree of these valve portions being increased and decreased according to the reciprocal movement of the operating rod (7). In these valve portions, the inner wall surface of a valve body or valve chest can be tapered. The operating rod (7) can also be moved back and forth in the vertical direction. In case a raw gas is converged with a primary air, it may be also be faced with the flow of the primary air.

6 Claims, 16 Drawing Sheets

FIG. 11
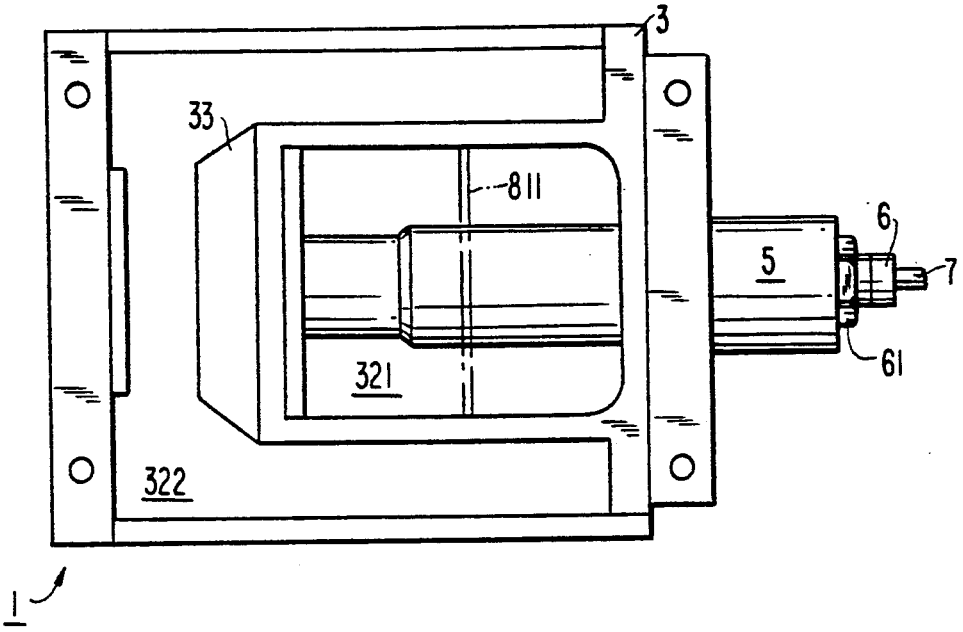
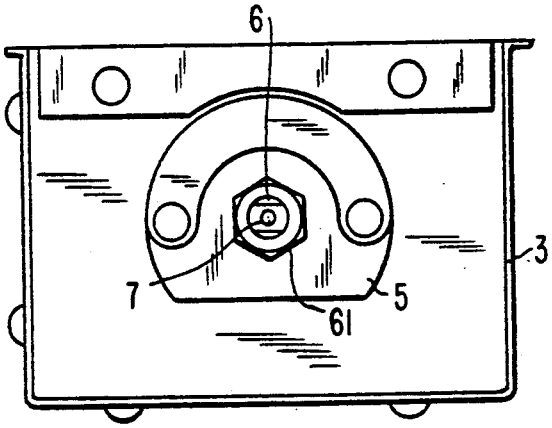
FIG. 12

GAS-AIR RATIO CONTROL VALVE DEVICE FOR GAS BURNERS

TECHNICAL FIELD

This invention relates to a gas-air ratio control valve which is used in a gas burner and adapted to properly control the feeding ratio of a primary air, a secondary air and a raw gas to the gas burner and which is chiefly used in a gas-type hot water supply system.

BACKGROUND ART

In a gas burner, it is necessary to secure a most appropriate proportion between a raw gas flow rate and an air flow rate in order to obtain a complete combustion.

To this end, heretofore, a primary air and a secondary air which were to be fed to a gas burner were controlled by properly varying the number of rotation of a centrifual blower or reducing the aperture of an air intake port of an air blower by means of an electronic control circuit or the like, and the raw gas which was to be fed to the gas burner was regulated in flow rate by increasing or decreasing the degree of the opening degree of a gas delivery valve.

However, according to such control means as mentioned, although there was no problem when the gas burner was at high load combustion, if a pressure change (an external factor, a rush of wind, etc.) should occur at the exhaust port side of the gas burner when the gas burner was at low load combustion, it had the shortcomings in that the flame of the gas burner was blown out, that carbon monoxide was generated, or that a back phenomenon of a flame was taken place and as a result, that a proper combustion was difficult to obtain.

Furthermore, the conventional control method had the shortcoming in that since the ratio of a secondary air with respect to a primary air was impossible to control, the generation of a combustion noise was difficult to restrain.

It is therefore an object of the present invention to provide a gas-air ratio control valve for gas burners, in which such shortcomings as inherent in the prior art as mentioned can be overcome, the flame of a gas burner is not blown out even if a pressure change (an external factor, a rush of wind etc.) is taken at an exhaust port side of the gas burner, a carbon monoxide is not generated, the back phenomenon of a flame can be prevented from being taken place, and as a result, a proper combustion can be obtained.

DISCLOSURE OF THE INVENTION

The present invention comprises a burner portion and a control portion for controlling a raw gas flow rate, a primary air flow rate and a secondary air flow rate;

said control portion being provided with a primary air chamber, a secondary air chamber and a raw gas chamber, said primary air chamber, secondary air chamber and raw gas chamber being communicated with said burner portion;

said control portion being provided with an operating rod which is able to move forward and backward, said control portion being also provided with a raw gas flow rate control valve portion, a primary air flow rate control valve portion and a secondary air flow rate control valve portion which are opened and closed according to the forward and backward movement of the operating rod;

said various valves being operated according to the forward and backward movement of said operating rod by means of a suitable actuator, so that the primary air flow rate flowed into said primary air chamber, the secondary air flow rate flowed into said secondary air chamber and the raw gas flow rate flowed into said raw gas chamber are controlled. By virtue of the foregoing arrangement, if the operating rod is moved forward and backward by the actuator, the raw gas flow rate control valve portion, the primary air flow rate control valve portion and the secondary air flow rate control portion can be interlocked without varying the pressure of the air-fuel mixture (a mixture of the primary air and the raw gas) which is to be fed to the gas burner.

In this invention, at the time when the raw gas flow rate control valve portion and the air flow rate control valve portion are to be constructed, if an annular valve seat which is secured to the valve box and a valve body which is secured to the operating rod, are concentrically arranged and if either an inner wall surface of the valve seat or the external wall surface of the valve body is formed in a tapered shape, the air ratio can be controlled simply by varying the angle of the taper of the external wall surface of the valve body.

In this invention, if only the raw gas control valve portion and primary air control valve portion are provided to the control portion and if the secondary air is freely fed to the gas burner portion, the structure of the control portion becomes simple.

Furthermore, at the time when this invention is to be constituted, if a basic barrel is provided with an air chamber and a raw gas chamber, and if the basic barrel is disposed in the vertical direction, and if the basic barrel is designed in such a manner as to be communicated with a gas burner through an opening at an upper end of the basic barrel, and if the basic barrel is formed at its side wall with an air window so that the air chamber is communicated with outside the basic barrel, and if the basic barrel is formed with a raw gas inlet port so that a raw gas generated in the raw gas chamber can be introduced therein, and if the basic barrel is provided at its axial center with an operating rod which is able to move forward and backward and if a raw gas flow rate control valve and an air flow rate control valve, which are opened and closed according to the forward and backward movement of the operating rod, are symmetrically disposed by serving the axial center of the basic barrel as the point of symmetry, and if the control valve is activated according to the forward and backward movement of the operating rod in the vertical direction by a suitable actuator, so that the control valve is actuated to control a primary air flow rate flowing from the air chamber to the gas burner portion and to control a raw gas flow rate flowing from the raw gas chamber to the gas burner portion, the air-fuel mixture discharged from the air outlet port of the control portion can easily be equalized because the air-fuel mixture flow rate which is to be fed to the control portion is controlled.

Furthermore, at the time when the present invention is to be constituted, in a gas-air ratio control valve for gas burners, in which a fixed barrel is disposed generally at the center of a basic barrel in the vertical direction, a primary air chamber being disposed between the fixed barrel and the basic barrel, the interior of the fixed barrel being served as a raw gas chamber, the basic barrel being formed at an upper end thereof with an opening and is communicated with a gas burner portion through the opening, the basic barrel being formed at a side wall thereof with an air window so that the primary air chamber is communicated with outside the basic barrel, the basic barrel being formed with a raw gas introducing passage so that a raw gas can be introduced into the raw gas chamber, the fixed barrel being provided with a reciprocation barrel as such that the reciprocation barrel can be moved forward and backward, the reciprocation barrel being further provided with a raw gas flow passage, the reciprocation barrel being moved forward and backward in the vertical direction by a suitable means thereby to actuate the primary air flow rate control valve portion and the raw gas flow rate control valve so that a primary air flow rate flowing from the primary air chamber to the gas burner portion is controlled and so that a raw gas flow rate flowing from the raw gas chamber and converging with the primary air through the raw gas flow passage is controlled, if the raw gas passage of the fixing barrel is opened up at the primary air chamber and if the opening is faced opposite with the flowing direction of the primary air, the raw gas flowed into the primary air chamber causes a turbulence together with the primary air and as a result, the raw gas can be uniformly mixed in a short flow passage.

Still further, at the time when the present invention is to be constituted, in a gas-air ratio control valve for gas burners which includes a gas burner and a ratio control valve for controlling an air-fuel mixture flow rate which is to be fed to the gas burner, the ratio control valve being provided with an air inlet port and a raw gas inlet port, the air inlet port being provided with an air blower, the raw gas inlet port being connected with a raw gas pipe through an electromagnetic valve, so that a pressure air is fed to the ratio control valve by means of activation of the air blower and so that a raw gas is fed to the ratio control valve through the raw gas pipe, the air blower being provided with an air pressure detecting means and the raw gas pipe being provided with a gas pressure detecting means, these detecting means being set with a set value so that the electromagnetic valve is closed when the air pressure of the air blower or the raw gas pressure of the raw gas pipe becomes other value than the set value, that is, the air blower being provided with an air pressure detecting means and the raw gas pipe being provided with a gas pressure detecing means, these detecting means being set with a set value so that the electromagnetic valve is closed when the air pressure of the air blower or the raw gas pressure of the raw gas pipe becomes other value than the set value.

Accordingly, raw gas and combusting air are fed to the flow rate control valve always under a predetermined pressure.

BRIEF DESCRIPTION OF THE DRAWINGS

FIGS. 6 through 8 show a sixth embodiment, in which FIG. 6 is a front sectional view, FIG. 7 is a right side view, and FIG. 8 is a plan view;

FIGS. 10 through 12 show an eighth embodiment, in which FIG. 10 is a front sectional view, FIG. 11 is a plan view, and FIG. 12 is a right side view;

FIGS. 13 and 14 show a ninth embodiment, in which FIG. 13 is a front sectional view, and FIG. 14 is a plan view;

FIGS. 17 through 20 show a twelfth embodiment, in which FIG. 17 is a front sectional view, FIG. 18 is a sectional view taken along line XVIII—XVIII of FIG. 17, FIG. 19 is side sectional view, and FIG. 20 is a cut-away perspective view of an important portion showing the arranging state of a secondary air flow rate control valve.

BEST MODE FOR CARRYING OUT THE INVENTION

In order to describe the present invention in more detail, the invention will be described with reference to the accompanying drawings.

Figure 1:
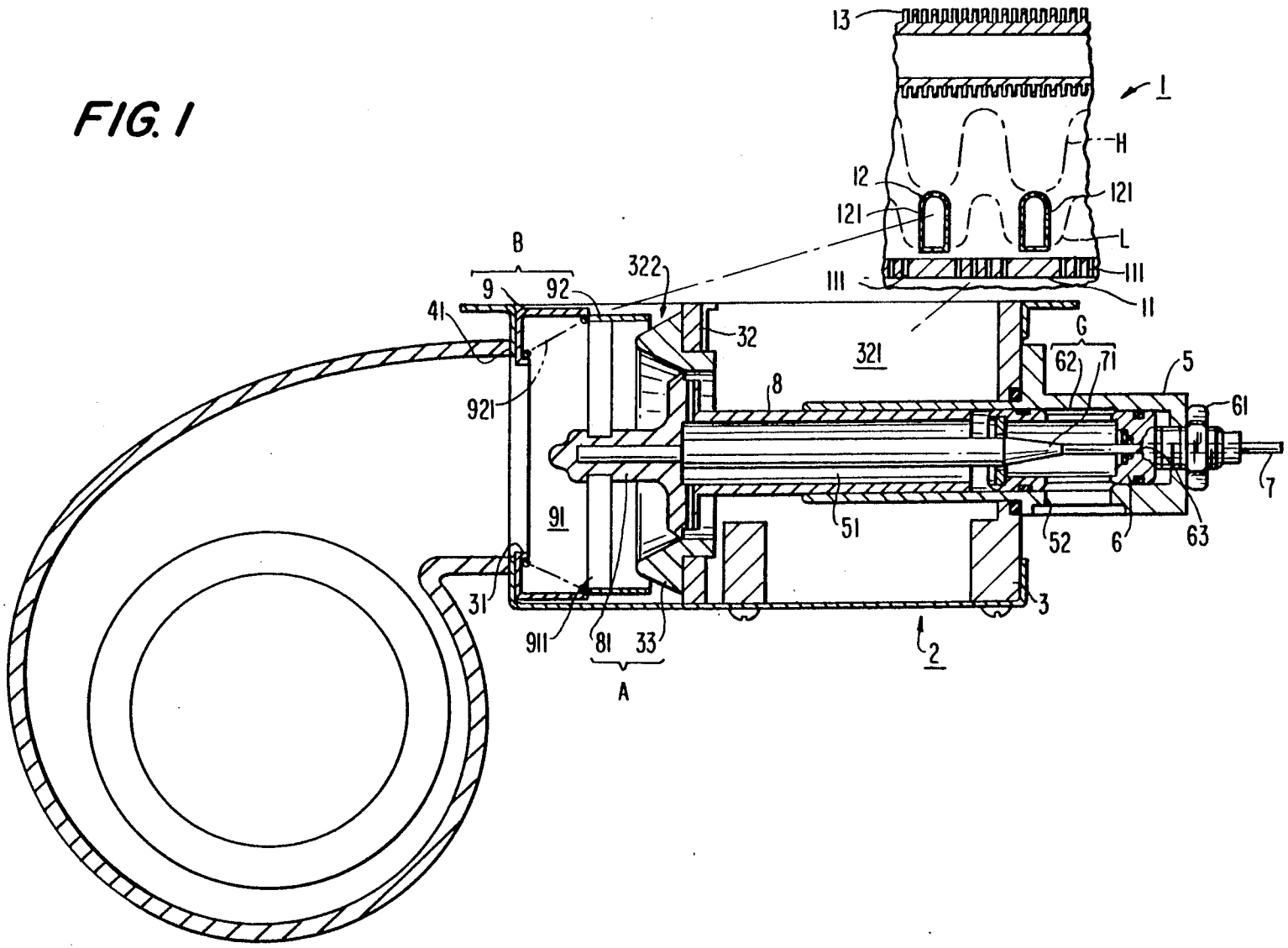
FIG. 1 is a sectional view of a first embodiment.

FIG. 1 shows a first embodiment.

In FIG. 1, 1 denotes a burner portion of a gas type hot water supplying system, and 2 denotes a control portion for controlling a raw gas flow rate, a primary air flow rate and a secondary air flow rate which are to be fed to the burner portion 1. The burner portion 1 and the control portion 2 are integrally formed through a casing 3.

The control portion 2 will be described next.

31 denotes an air inlet port which is integral with the control portion 2. The air inlet port 31 is connected with an outlet port 4 of an air blower 4. 5 denotes a supporting barrel 5 which is fitted to the side of the casing 3. The supporting barrel 5 is opened up within the casing 3, the interior thereof functioning as a raw gas chamber 51. 52 denotes a raw gas introducing passage which is formed in the supporting barrel 5. The raw gas introducing passage 52 is adapted to introduce a raw gas from outside into the raw gas chamber 51. 6 denotes a cylindrical valve box member which is fitted into the supporting barrel 5. The rear end of the valve box member 6 is thrusted through the supporting barrel 5. 61 denotes a nut which is engaged with a projecting portion of the valve box member 6 to form a so-called double nut structure for securing the valve box member 6. 62 denotes an annular valve seat which is secured to the front end port of the valve box member 6. The function of the valve seat 62 will be described afterward. 52 denotes a shaft hole formed in a right end portion (in FIG. 1) of the valve box member 6, and 7 denotes an operating rod which is reciprocally movably inserted into the shaft hole 63. 71 denotes a valve body which is integral with an intermediate portion of the operating rod 7. The external wall surface of the valve body 71 is tapered and forms a raw gas flow rate control valve G of the present invention together with the annular valve seat 62. The opening area of the raw gas flow rate control valve G is increased and decreased according to the reciprocal movement of the operating rod 7 thereby to control the flow rate of a raw gas passed.

Next, 32 denotes a partition wall which is secured to the case 3. The partition wall 32 partitions the interior of the case 3 into a primary air chamber 321 and a secondary air chamber 322. 33 denotes an annular valve seat which is fitted to the partition wall 32. The internal wall surface of the valve seat 33 is tapered. 8 denotes a reciprocal barrel 8 which is reciprocally movably fitted into the supporting barrel 6. The reciprocal barrel 8 is secured to a left end of the operating rod 7 and is reciprocally moved according to the reciprocal movement of the operating rod 7. 81 denotes a disk-shaped valve body which is integral with a right end of the reciprocal barrel 8. The valve body 81 constitutes a primary air control valve A together with the valve seat 33. The primary air flow rate control valve A increases or decreases its opening area according to the reciprocal movement of the operating rod 7, thereby to control a primary air flow rate which is to be flowed into the primary air chamber 321. 811 denotes a raw gas discharging passage which is radially formed in the valve body 81. The raw gas discharging passage 811 causes the interior of the reciprocal barrel 8 to be communicated with the primary air chamber 321 to discharge a raw gas into the primary air chamber 321. The raw gas flowed into the primary air chamber 321 is mixed with a primary air in the primary air chamber 321.

Next, 9 denotes a fixed barrel which is secured to the case 3. The fixed barrel 9 partitions the interior of the case 3 into a compression air chamber 91 and the secondary air chamber 322. 92 denotes a valve barrel which is integral with a projecting portion of the valve body 81 through a connecting piece 911. The valve barrel 92 is reciprocally movably fitted into the fixed barrel 9. The reciprocal movement of the valve barrel 92 increases or decreases the opening area between the partition wall 32 and the valve barrel 92. That is, the valve barrel 92 and the fixed barrel 9 constitute a secondary air flow rate control valve B of the present invention and control a secondary air flow rate, which is to be flowed into the secondary air chamber 322, according to the reciprocal movement of the operating rod 7. 921 denotes a return spring for returning the operating rod 7 into its original state.

Furthermore, the burner portion 1 will be described.

In the figure, 11 denotes a head plate of a burner. The inner side of the burner head plate 11 is communicated with the primary air chamber 321 of the control portion 2. 111, 111, . . . denote flame holes formed in the burner head plate 11. The flame holes 111, 111, . . . are adapted to discharge an air-fuel mixture outside the burner head plate 11. The air-fuel mixture discharged constitutes, when ignited, an internal flame L. 12 denotes a secondary air pipe, which is disposed to an upper location of the burner head plate 11. The secondary air pipe 12 is communicated with the secondary air chamber 322 of the control portion 2. 121, 121, . . . denote tiny holes which are formed in the secondary air pipe 12. The tiny holes 121, 121, . . . are adapted to discharge a secondary air to the upper part of the internal flame L. The secondary air discharged assists the combustion of the air-fuel mixture and forms an external flame H at an upper part of the internal flame L. 13 denotes a heat exchanger which disposed to an upper part of the external flame H. The heat exchanger 13 is adapted to heat water until it becomes a hot water.

Next, the operation of the above-mentioned embodiment will be described.

If the operating rod 7 is moved in the left direction, i.e., pushed in by a suitable actuator, the opening areas of the raw gas flow rate control valve G, the primary air flow rate control valve A and the secondary air flow rate control valve B become large. Due to the foregoing, the air-fuel mixture and the secondary air which are to be fed to the burner portion 1 are increased. And, when the operation of the actuator is over, the operating rod 7 is restored to its original state by means of the function of a return spring 921.

Figure 2:
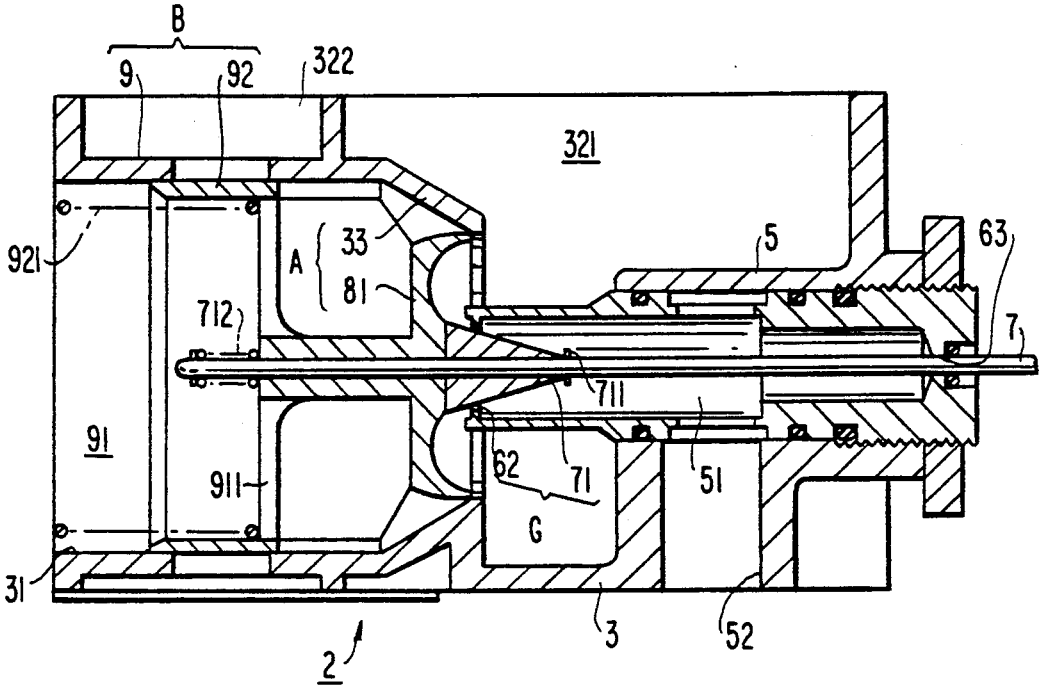
FIG. 2 is a sectional view of a second embodiment.

FIG. 2 shows a second embodiment.

In the example of the second embodiment, the supporting barrel 5 and the valve seat of the primary air flow rate control valve A are integral with the case 3. Also, the valve body 71 of the raw gas flow rate control valve G and the valve body 81 of the primary air flow rate control valve A in this embodiment are contacted with each other and fitted to the outer periphery of the operating rod 7 and then held between the retaining pin 711 and the compression spring 712.

Figure 3:
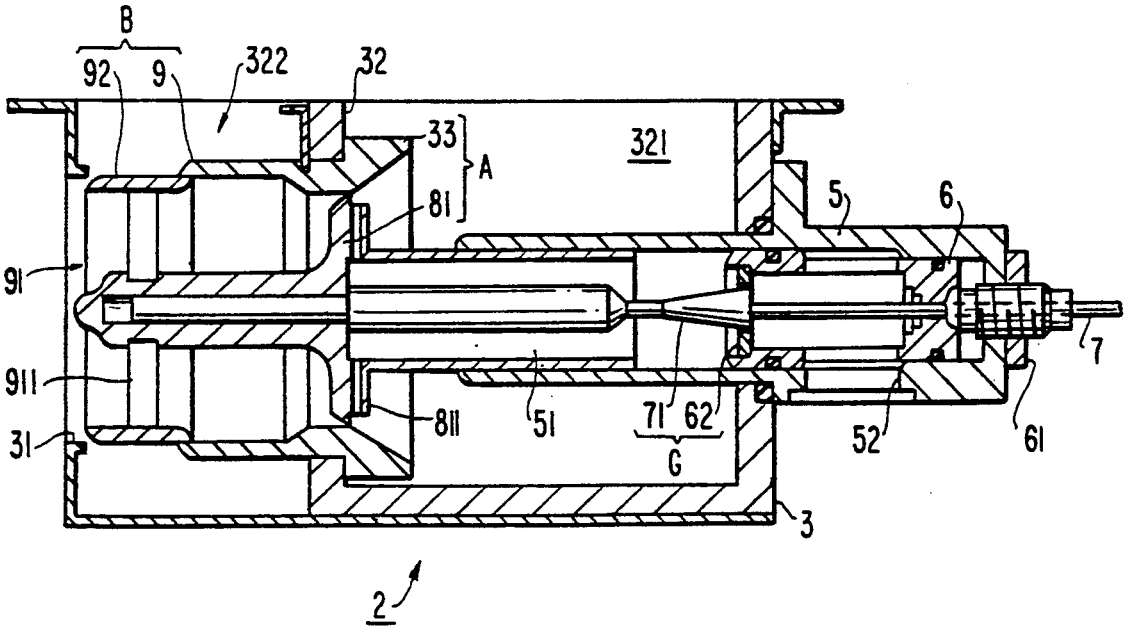
FIG. 3 is a sectional view of a third embodiment.

FIG. 3 shows a third embodiment.

In the example of the third embodiment, the tapered surface of the valve seat 81 o the primary air flow rate control valve A and the valve body 71 of the raw gas control valve G is in the reversed inclination as those of the first and the second embodiments. Due to foregoing, when the operating rod 7 is moved in the right direction, i.e., withdrawn, the opening areas of the raw gas flow rate control valve G, the primary air flow rate control valve A and the secondary air flow rate control valve B become large.

Figure 4:
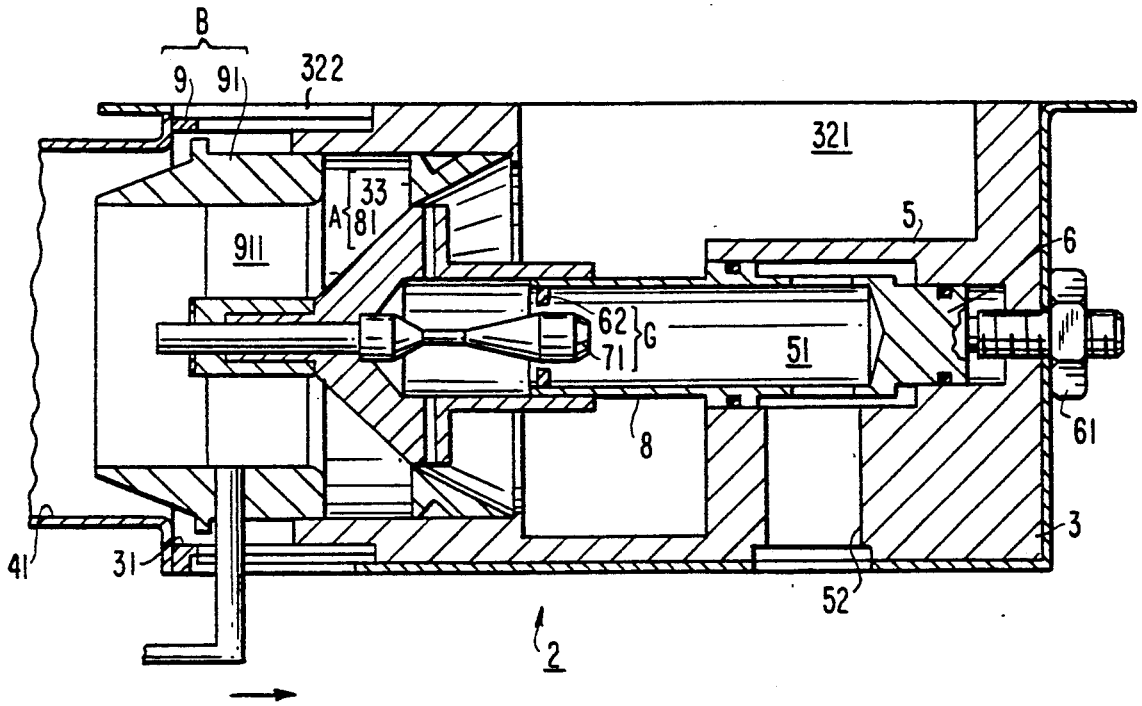
FIG. 4 is a sectional view of a fourth embodiment.
Figure 5:
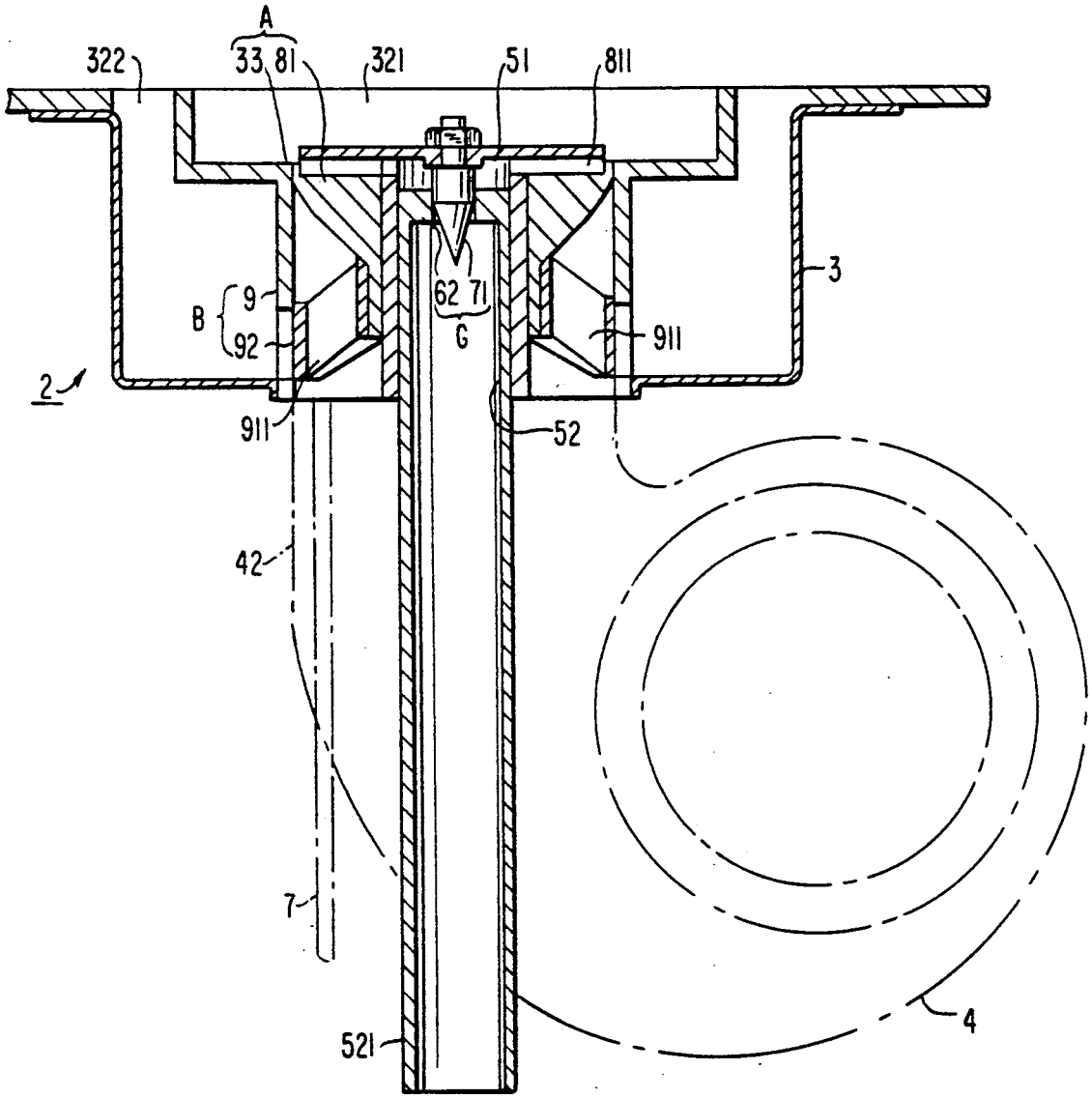
FIG. 5 is a sectional view of a fifth embodiment.

FIG. 4 shows a fourth embodiment.

In the example of the fourth embodiment, an outer wall surface of the valve body 81 of the secondary air flow rate control valve B is tapered.

Also, the operating rod 7 is secured to the valve body 81 and, when moved in the right direction (in the direction as shown by an arrow in the figure), the raw gas flow rate control valve G, the primary air flow rate control valve A and the secondary air flow rate control valve B are opened.

In the example of the fifth embodiment, a gas flow-in pipe and the operating rod 7 penetrate the blast pipe 42 of the air blower 4. In this embodiment, when the operating rod 7 is moved in the upward direction, i.e., pushed in, the raw gas flow rate control valve G, the primary air flow rate control valve A and the secondary air flow rate control valve B are opened.

In the above-mentioned embodiments, the actuator used is of the type which is actuated, for example, by variation of pressure, temperature, etc. of water which is to be fed to a heat exchanger.

Figure 6:
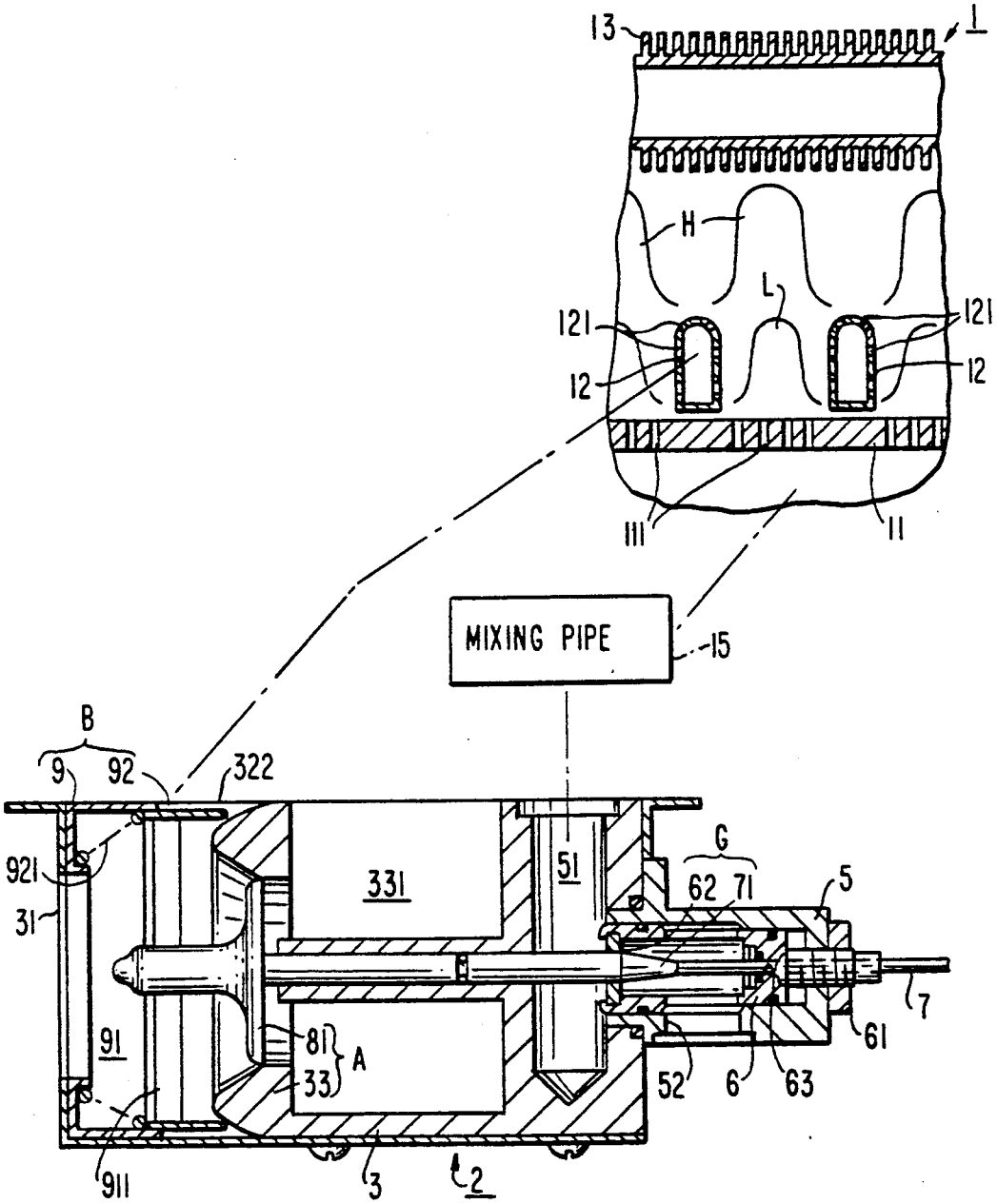
Figure 7:
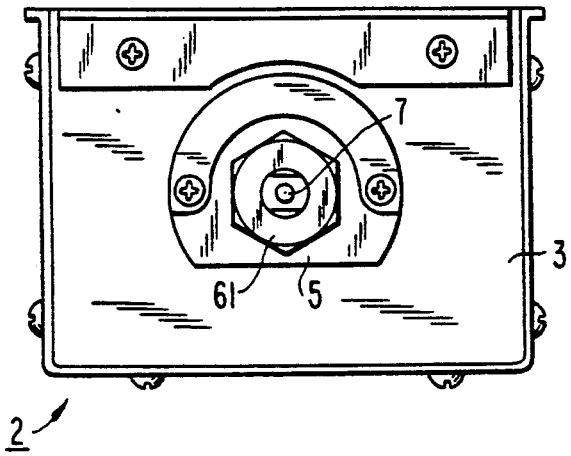
Figure 8:
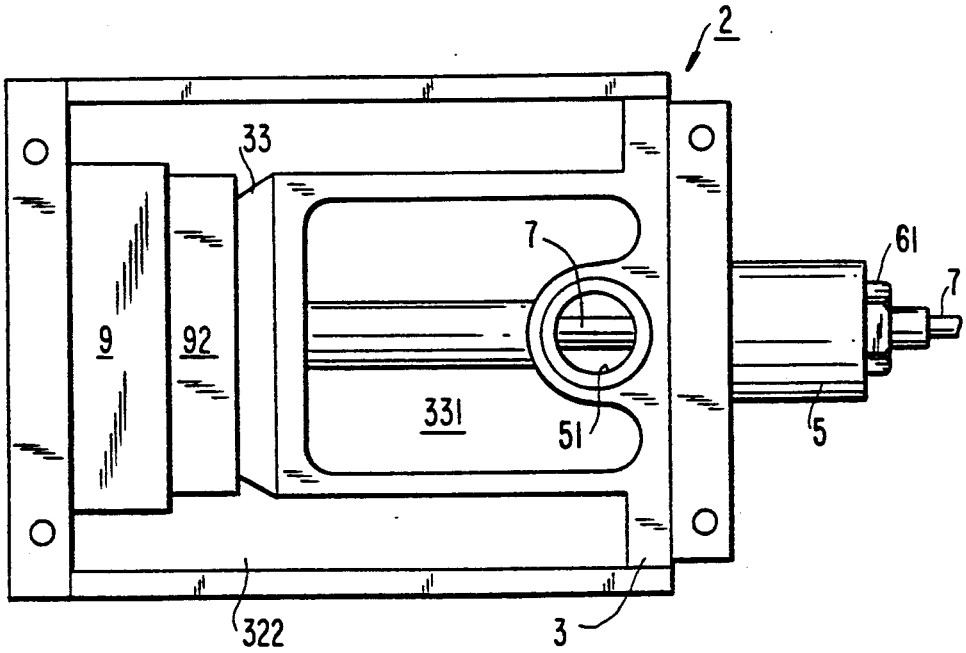

FIGS. 6 through 8 show a sixth embodiment.

In the example of this embodiment, the raw gas chamber 51 is independent of a primary air chamber 331 in the control portion 2, and the raw gas and the primary air are mixed together after they flowed out of the control portion 2.

Figure 9:
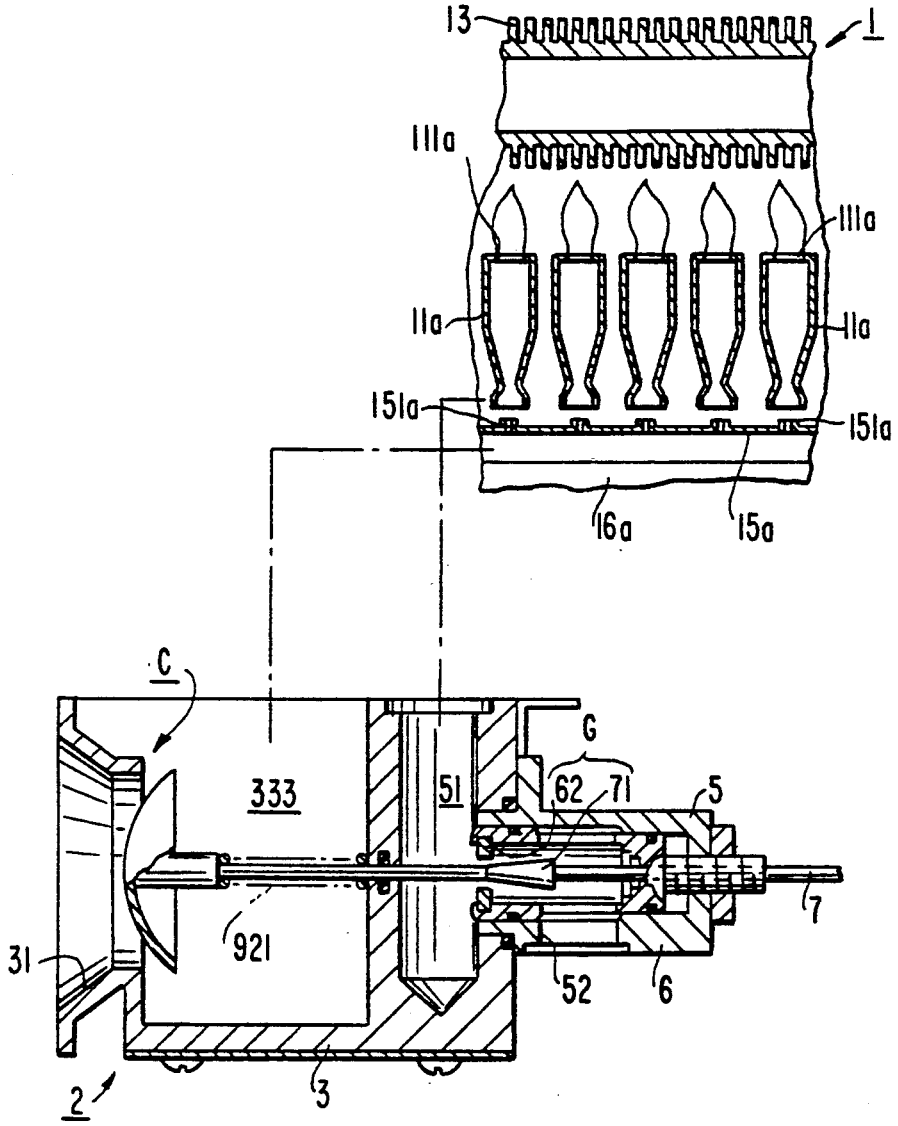
FIG. 9 is a front sectional view of a seventh embodiment.

FIG. 9 shows a seventh embodiment.

In the example of this embodiment, the invention is applied to a blast-type burner. In the figure, 11*a* denotes a burner, and 111*a* denotes a flame hole of the burner 11*a*. 16*a* denotes an air chamber which is formed below the burner 11*a*. This air chamber 16*a* communicates with a combustion air chamber 333 for the control portion 2. 15*a* denotes a fuel pipe which is formed at an upper portion of the air chamber 16*a*. This fuel pipe 15*a* communicates with the raw chamber 51 of the control portion 2. 151*a* denotes a nozzle which is formed at the fuel pipe 15*a*. This nozzle 151*a* jets a raw gas toward the burner 11*a* for supplying. C denotes an air flow rate control valve.

Figure 10:
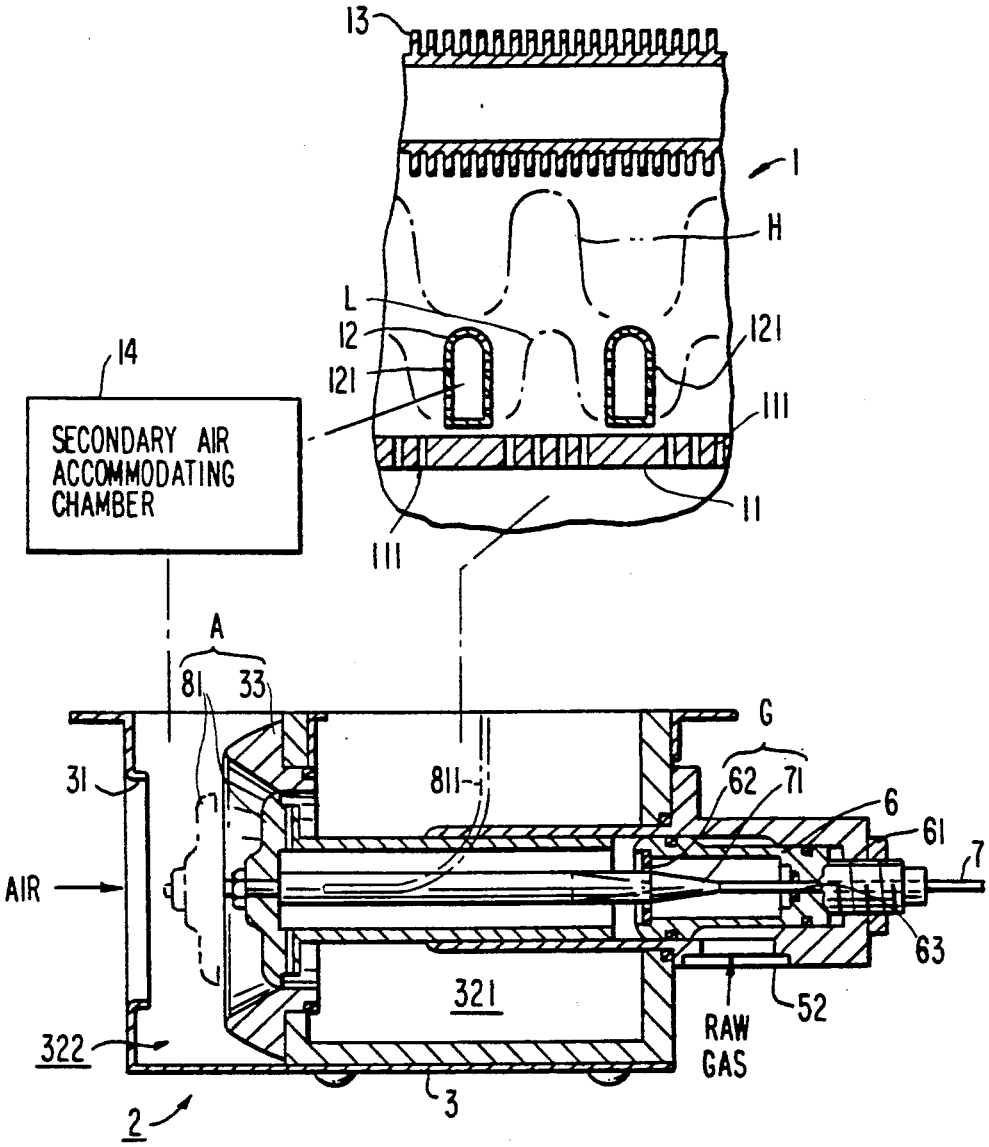

FIGS. 10 through 12 show an eighth embodiment.

In the example of this embodiment, the secondary air is not controlled in the control portion 2.

In FIG. 10, 811 denotes a guide plate which is adapted to equalize the pressure of the air-fuel mixture which is to be fed to the gas burner portion 1.

Figure 13:
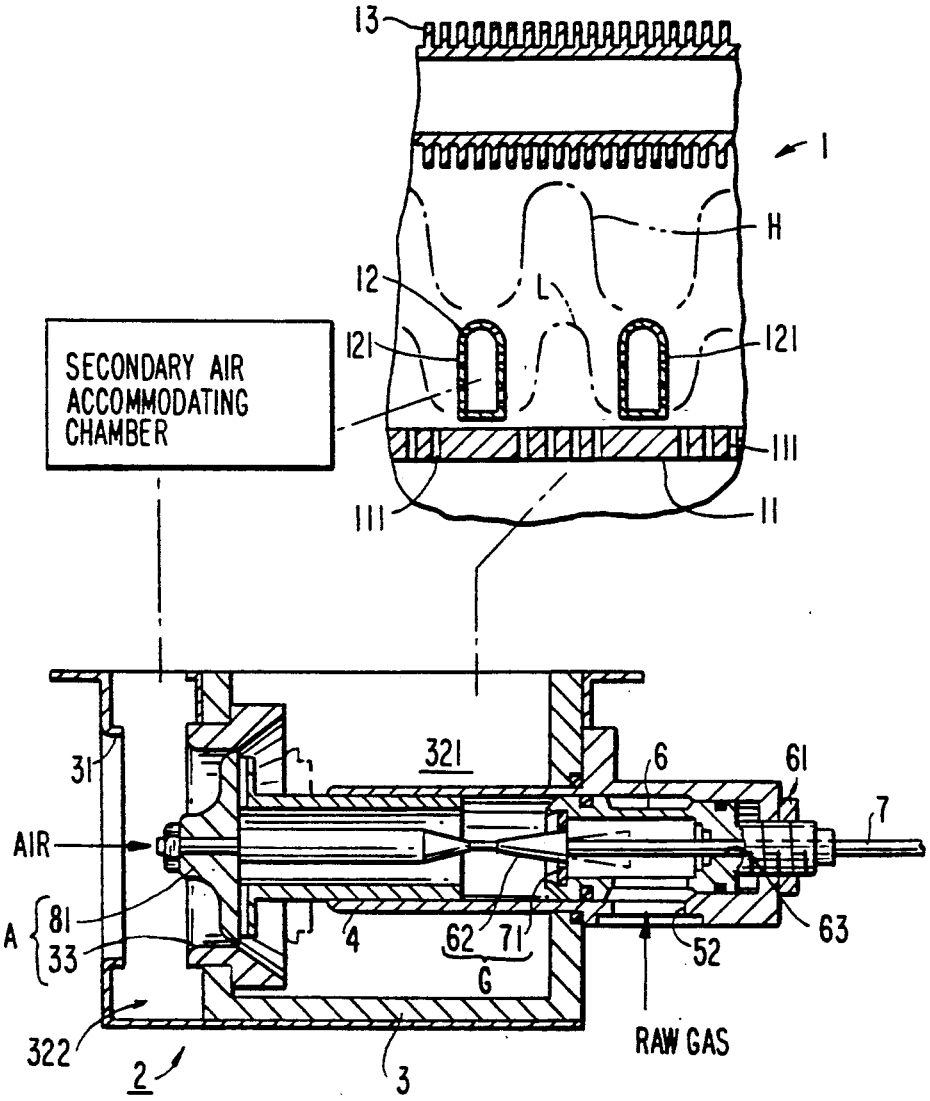
Figure 14:
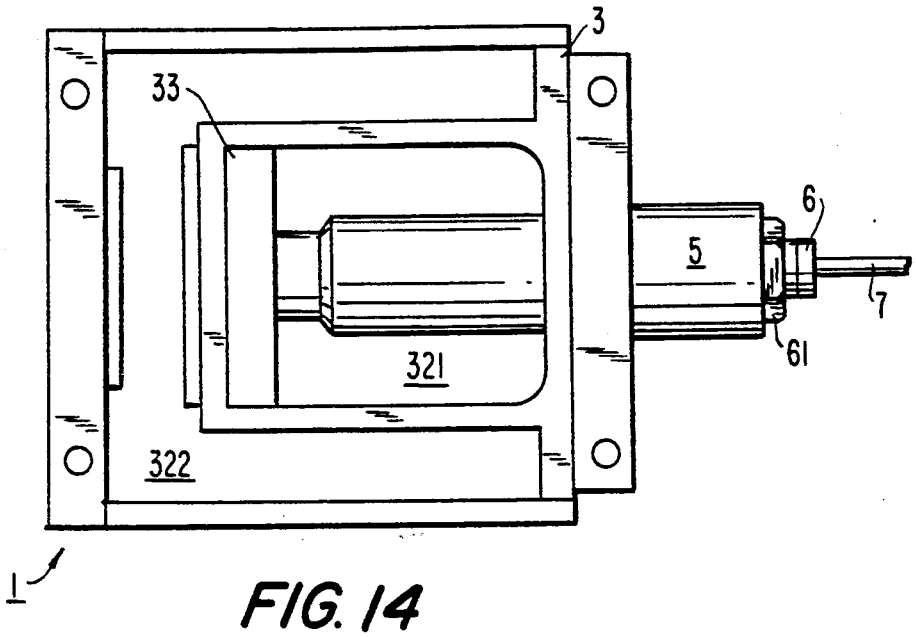

FIG. 13 and FIG. 14 show a ninth embodiment.

In the example of this embodiment, since the taper of the valve portions A and G is formed in the opposite direction to that of the eighth embodiment, the operating rod 7 is moved back and forth in the opposite direction in order to obtain the same motion as that of the eighth embodiment.

Figure 15:
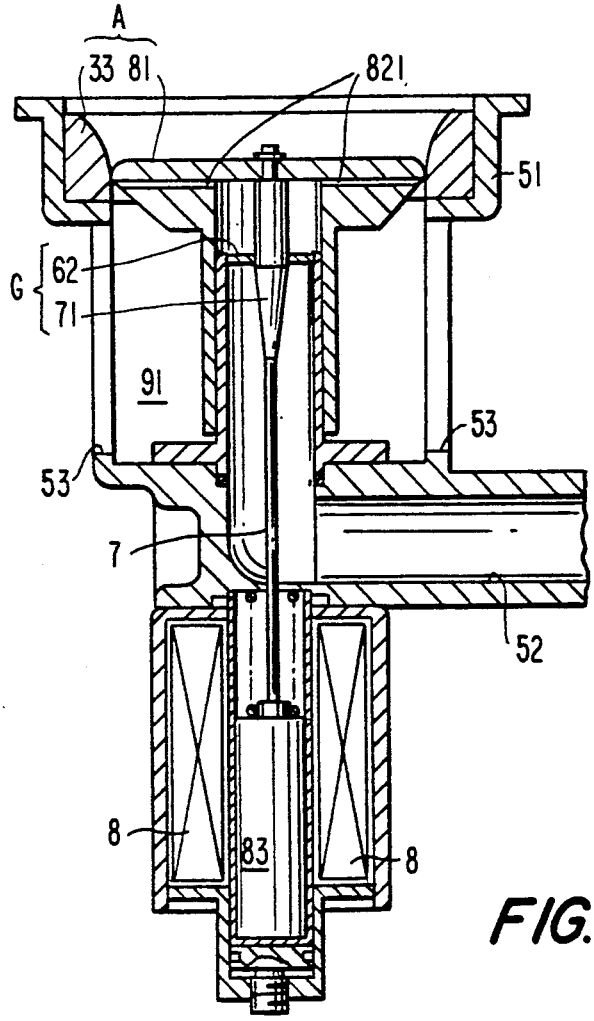
FIG. 15 is a front sectional view of a tenth embodiment.

FIG. 15 shows a tenth embodiment.

In the example of this embodiment, the operating rod 7 is vertically moved back and forth and a solenoid 8 is used as an actuator.

The operation of this embodiment will be described.

When an electric current flows into the solenoid 8, an iron core 83 and hence an operating rod 57 are moved in the vertical direction, and the opening areas of the raw gas flow rate control valve G and the primary air flow rate control valve A become large. Due to the foregoing, an air-fuel flow rate which is to be fed to a gas burner portion (not shown) is increased and as a result, the combustion quantity of heat is increased. And, when the flowing of the electric current into the solenoid 8 is stopped, the iron core 83 and thus the operating rod 7 are energized by a spring (not shown) and moved downward, and the opening areas of the raw gas flow rate control valve G and the primary air flow rate control valve A become small. Due to the foregoing, the air-fuel mixture which is to be fed to the gas burner portion (not shown) is decreased and as a result, the combustion quantity of heat is decreased and restored to its original state. In the figures, the basic barrel 55 corresponds to the case. Similarly, 53 denotes an air window.

Figure 16:
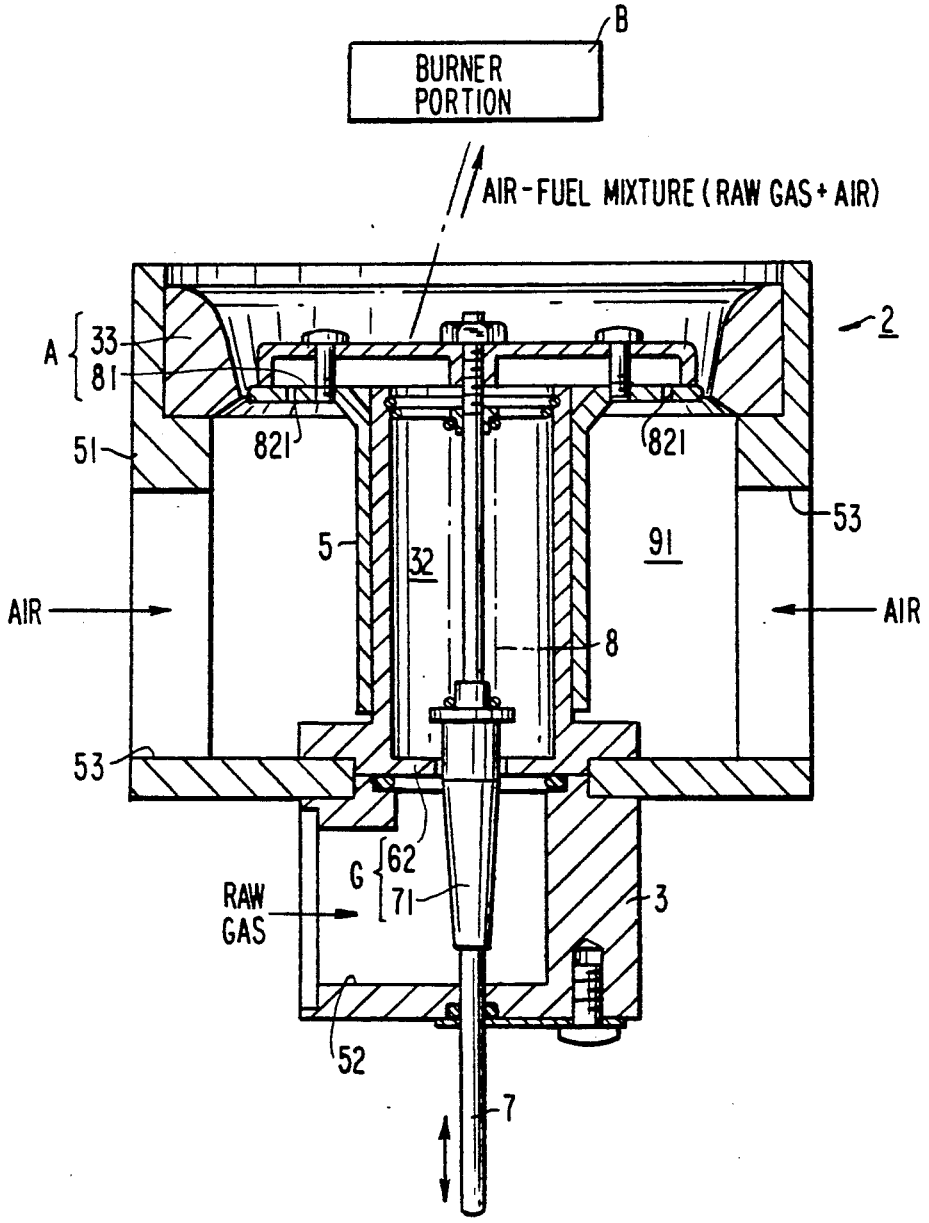
FIG. 16 is a sectional view when viewed from the front.
Figure 17:
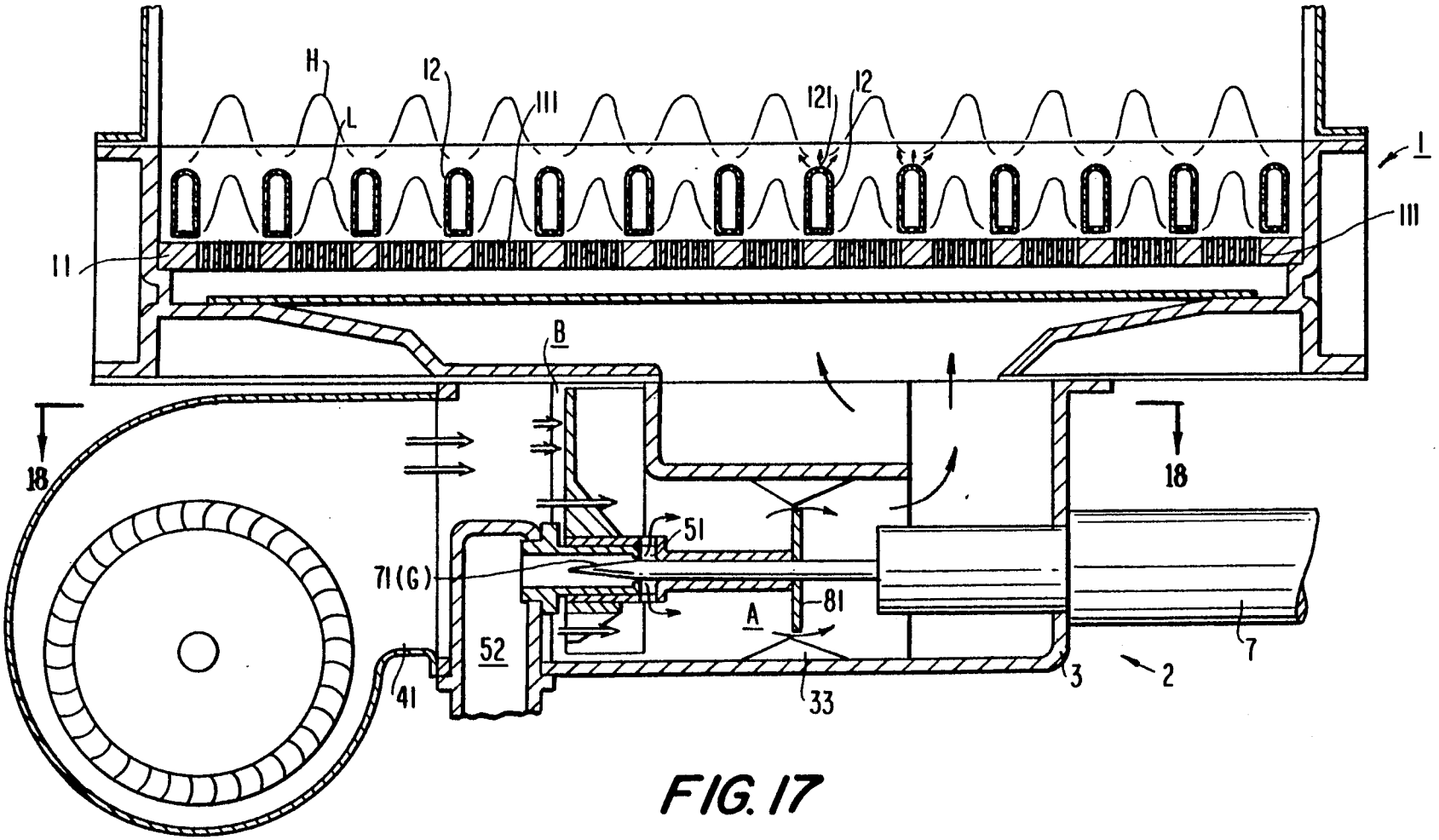
Figure 18:
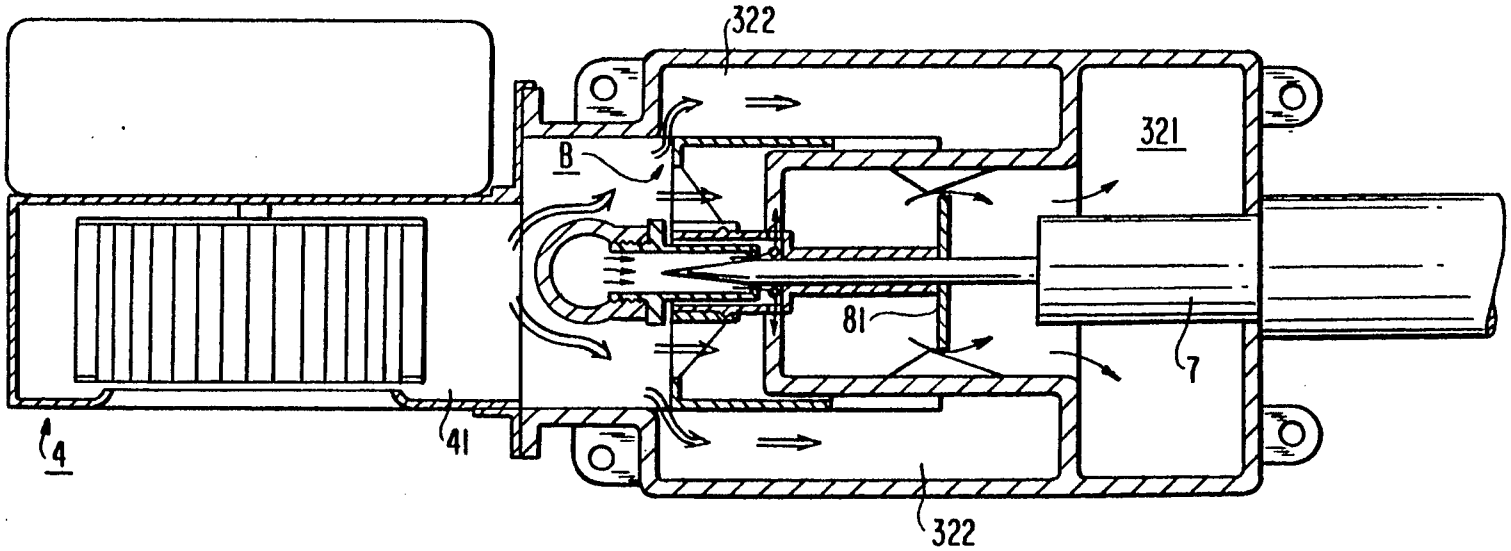
Figure 19:
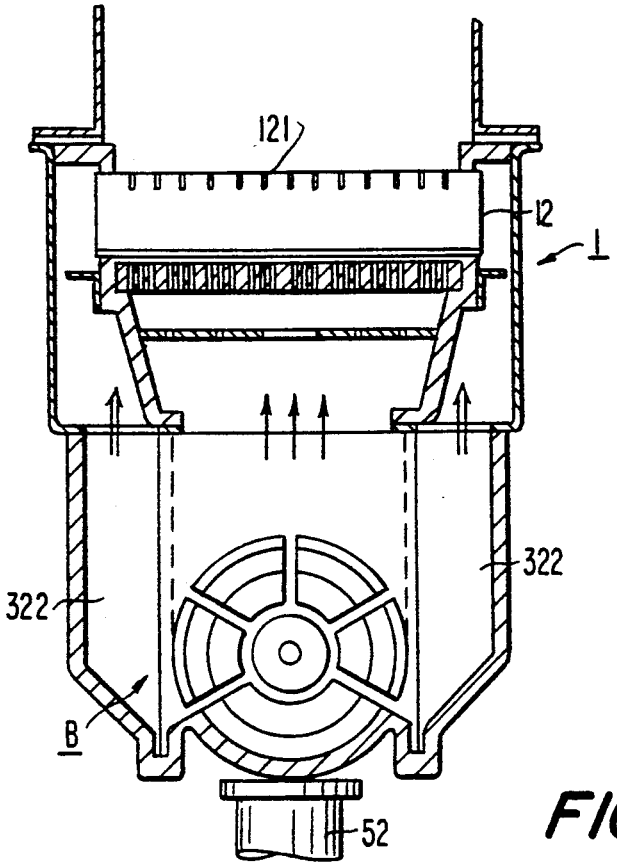
Figure 20:
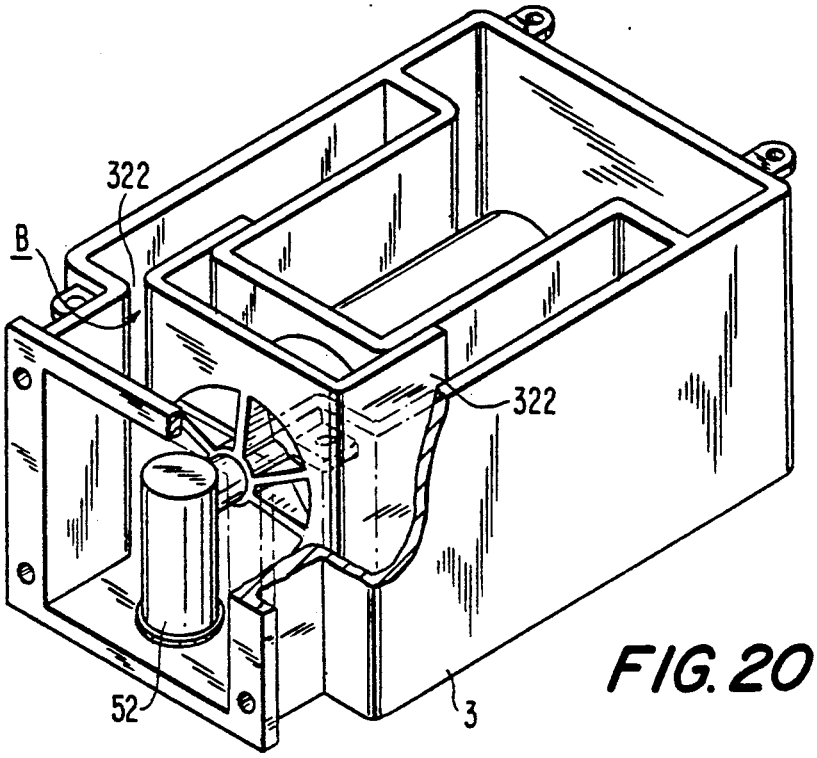

FIG. 16 denotes an eleventh embodiment.

In the example of this embodiment, a primary air nozzle 821 is opened in such a manner as to face with the flow of a primary air.

FIGS. 17 through 20 show a twelfth embodiment.

Figure 21:
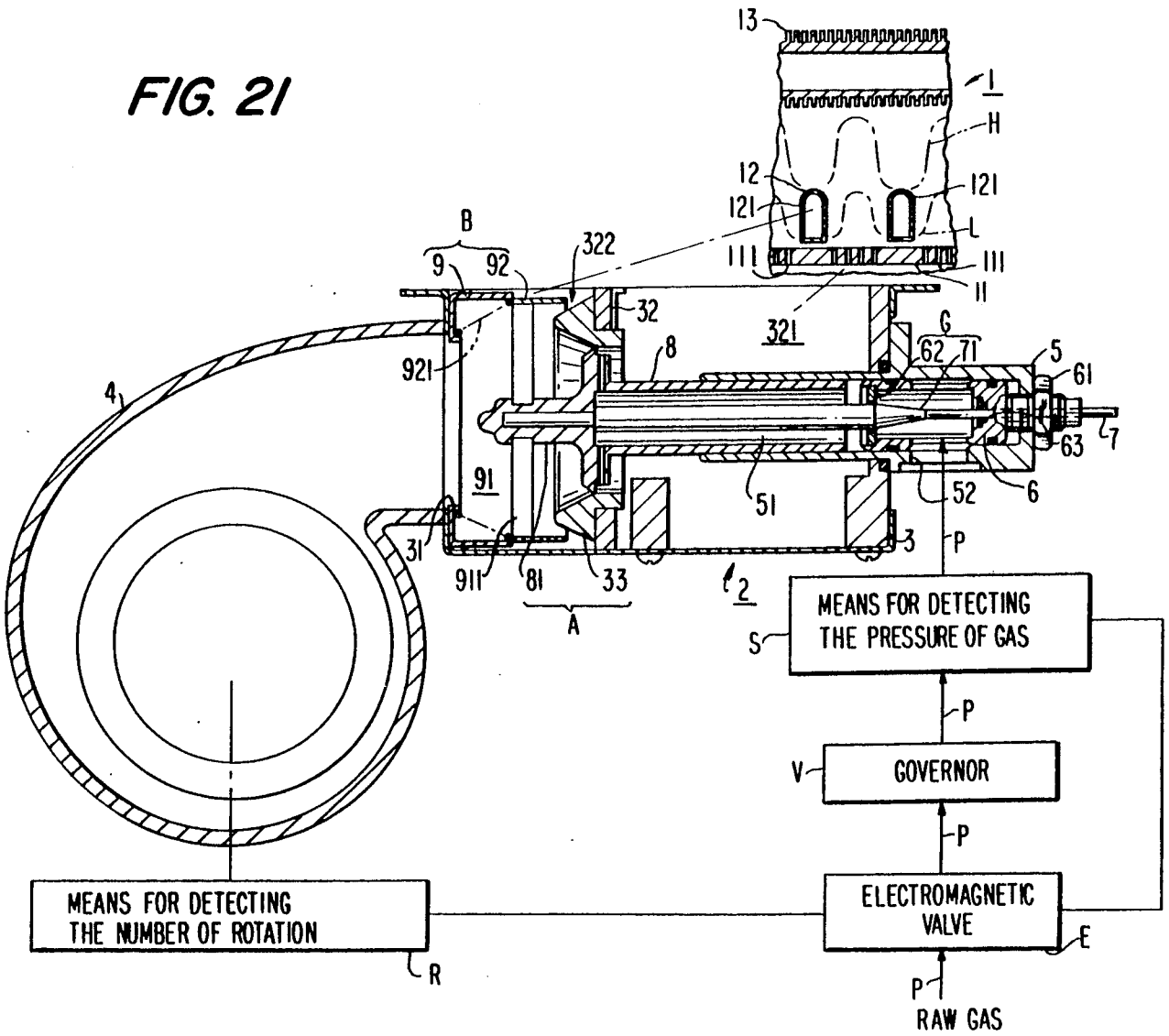
FIG. 21 is a sectional view of a thirteenth embodiment.

FIG. 21 shows a thirteenth embodiment.

In this embodiment, R denotes means for detecting the number of rotation (means for detecting the pressure of a combustion air of this invention) which is adapted to detect the number of rotation of an air blasting fan. Similarly, P denotes a raw gas pipe which is connected to a raw gas inlet port 52 of the ratio control valve 2. E denotes an electromagnetic valve which is disposed at the raw gas pipe P, V denotes a governor which is disposed at a downstream side of the electromagnetic valve E, and S denotes a pressure switch (corresponding to the means for detecting the gas pressure of this invention) which is disposed at a downstream side of the governor V. The number of rotation detecting means R and the pressure switch S are established in set values, and when the number of rotation of the air blasting fan and the pressure of the raw gas become something other than the set values, the electromagnetic valve E is closed.

As for the combustion air pressure detecting means, a pressure switch may be used.

POSSIBILITY FOR INDUSTRIAL USE

As described in the foregoing, a gas-air ratio control valve for gas burners according to the present invention is useful as means for controlling the feeding of a combustion air and raw gas to a gas burner, and particularly, it is suitable for the use in a gas-type hot water supplying system.

What is claimed:

1. A gas-air ratio control valve for gas burners comprising a burner portion and a control portion for controlling a raw gas flow rate, a primary air flow rate and a secondary air flow rate;

said control portion including a primary air chamber, a secondary air chamber and a raw gas chamber, said primary air chamber, secondary air chamber and raw gas chamber each communicating with said burner portion;

said control portion having an operating rod movable between inner and outer positions, said control portion further including a raw gas flow rate control valve portion, a primary air flow rate control valve portion and a secondary air flow rate control valve portion which are opened and closed according to the movement of the operating rod;

an actuator for moving said operating rod, said valve portions being opened and closed by movement of the operating rod, so that the primary air flow rate into said primary air chamber, the secondary air flow rate into said secondary air chamber and the raw gas flow rate into said raw gas chamber are controlled.

2. A gas-air ratio control valve for gas burners as claimed in claim 1 wherein said raw gas flow rate control valve portion includes a valve box, an annular valve seat secured to said valve box, and a valve body secured to said operating rod and having an inner wall surface, said valve seat and valve body are concentrically arranged and one of said inner wall surface and said valve seat is tapered.

3. A gas-air ratio control valve for gas burners as claimed in claim 2 wherein said primary air chamber forms a separate chamber from said raw gas chamber.

4. A gas-air ratio control valve for gas burners, in which a fixing barrel is disposed generally at the center of a basic barrel in the vertical direction, a space between said fixing barrel and said basic barrel forms a primary air chamber, and the interior of the fixing barrel forms a raw gas chamber;

said basic barrel having an opening at its upper end providing communication with a gas burner portion;

said basic barrel having an air window formed in a side wall so that said primary air chamber communicates with a region outside said basic barrel;

said basic barrel having a raw gas introducing passage so that a raw gas can be introduced into said raw gas chamber;

said fixing barrel having a reciprocation barrel, said reciprocation barrel is movable upwardly and downwardly, and said reciprocation barrel further includes a raw gas flow passage; and actuating means for moving said reciprocation barrel in the vertical direction to thereby actuate said primary air flow rate control valve portion and said raw gas flow rate control valve portion so that a primary air flow rate flowing from said primary air chamber to said gas burner portion is controlled and so that a raw gas flow rate flowing from said raw gas chamber and converging with said primary air through said raw gas flow passage is controlled; wherein said raw gas flow passage of said fixing barrel has an opening providing communication with said primary air chamber and said opening faces in an opposite direction to the flow direction of said primary air.

5. A gas-air ratio control valve for gas burners including a gas burner and a ratio control valve for controlling an air-fuel mixture flow rate fed to said gas burner; and said ratio control valve having an air inlet port and a raw gas inlet port, and an electromagnetic valve, said air inlet port including an air blower, said raw gas inlet port receiving raw gas through said electromagnetic valve, air being fed to said ratio control valve by activation of said air blower and raw gas is fed to said ratio control valve through said raw gas inlet port;

said air blower including air pressure detecting means connected to said electromagnetic valve and said raw gas inlet port including a gas pressure detecting means connected to said electromagnetic valve, said air and gas pressure detecting means each having a respective predetermined actuation value, said electromagnetic valve closing by actuation of at least one of said detecting means in response to one of air pressure provided by said air blower and raw gas pressure of said raw gas inlet port differing respectively from said predetermined value.

6. A safety device for a gas-air ratio control valve for gas burners as claimed in claim 5 wherein said air blower has a rotating impeller, and said air pressure detecting means comprises means for detecting the number of rotations of said rotating impeller.

* * * * *